US010221007B2

(12) United States Patent
Philpot et al.

(10) Patent No.: US 10,221,007 B2
(45) **Date of Patent: *Mar. 5, 2019**

(54) AEROSOL CAN ADAPTOR

(71) Applicant: Air Liquide Healthcare America Corporation, Houston, TX (US)

(72) Inventors: Spencer Philpot, Philadelphia, PA (US); Roderic N. Uphaus, Troy, AL (US)

(73) Assignee: Air Liquide Healthcare America Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/367,964

(22) Filed: Dec. 2, 2016

(65) Prior Publication Data

US 2017/0158416 A1 Jun. 8, 2017

Related U.S. Application Data

(60) Provisional application No. 62/263,267, filed on Dec. 4, 2015.

(51) Int. Cl.

| | |
|---|---|
| ***F17C 13/04*** | (2006.01) |
| ***B65D 83/20*** | (2006.01) |
| ***B65D 83/44*** | (2006.01) |

(52) U.S. Cl.

CPC ..... *B65D 83/201* (2013.01); *B65D 83/205* (2013.01); *B65D 83/207* (2013.01); *B65D 83/44* (2013.01)

(58) Field of Classification Search

CPC ..... B65D 83/201; B65D 83/44–83/83; B65D 83/207; B65D 83/205; F17C 13/04

USPC ..... 222/399, 402.1–402.25, 1

See application file for complete search history.

(56) References Cited

U.S. PATENT DOCUMENTS

| | | | | |
|---|---|---|---|---|
| 5,467,798 A * | 11/1995 | Baker | ..... | F17C 13/04 137/614.2 |
| 6,539,988 B1 * | 4/2003 | Cowan | ..... | B60H 1/00585 137/614.04 |
| 2012/0228337 A1 * | 9/2012 | Gandy | ..... | B65D 83/48 222/402.25 |

* cited by examiner

*Primary Examiner* — Patrick M Buechner
*Assistant Examiner* — Robert Nichols, II
(74) *Attorney, Agent, or Firm* — Elwood L. Haynes

(57) ABSTRACT

An adaptor including a lower fitting including a central axial opening including a pin valve, a lower travel stop, a lower crimp ring seating surface, an upper fitting including a male thread, a seating radius configured to conform with a curled lip of the aerosol can, an upper travel stop, configured to contact the lower travel stop during assembly, an upper crimp ring seating surface, a crimp ring configured to rest between the lower crimp ring seating surface and the upper crimp ring seating surface and configured to compressed in the axial direction while simultaneously expanding in the radial direction during installation.

9 Claims, 5 Drawing Sheets

AEROSOL CAN ADAPTOR

CROSS REFERENCE TO RELATED APPLICATIONS

This application claims the benefit of priority under 35 U.S.C. § 119 (a) and (b) to U.S. Patent Application No. 62/263,267 filed Dec. 4, 2015, the entire contents of which are incorporated herein by reference.

BACKGROUND

A revision to regulations allows for refrigerant 134a to be filled into small, easily portable aerosol cans, provided the aerosol can meets the minimum requirements outlined in the shipping regulations. Previously, R134a has been filled into 1 liter steel containers that have CGA-600 valves. The equipment that the aerosol can connects to has been designed and built to accommodate an aerosol can with a CGA-600 valve. No CGA-600 valve currently exists that can connect to an aerosol can. A need now exists in the industry for such an aerosol can CGA-600 valve adaptor.

SUMMARY

An adaptor including a lower fitting including a central, axial opening including a pin valve, a lower travel stop, a lower crimp ring seating surface, an upper fitting including a male thread, and a seating radius configured to conform with a curled lip of the aerosol can, an upper travel stop, configured to contact the lower travel stop during assembly, and an upper crimp ring seating surface, and a crimp ring configured to rest between the lower crimp ring seating surface, and the upper crimp ring seating surface, and configured to compressed in the axial direction while simultaneously expanding in the radial direction during installation.

BRIEF DESCRIPTION OF THE FIGURES

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

Figure 2B:
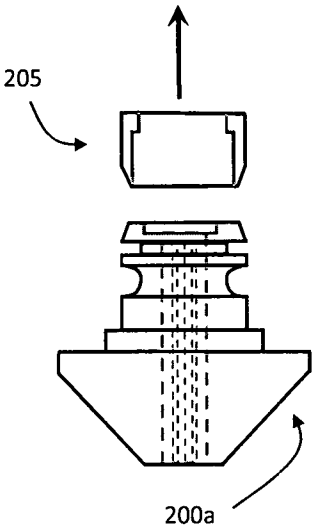
FIG. 2*b* is a schematic representation of the lower fitting illustrating the separation of the pull-ring.

Illustrative embodiments of the invention are described below. While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure

ELEMENT LIST

100=aerosol can
101=curled lip (of aerosol can)
102=inner surface (of aerosol can)
200=lower fitting
200*a*=lower fitting (without pull ring)
201=central axial opening (of lower fitting)
202=pin valve
203=lower travel stop
204=lower crimp ring seating surface
205=pull ring
206=exterior first o-ring groove
207=second o-ring seat
208=inner retaining ring groove
300=upper fitting
301=male thread (on upper fitting)
302=seating radius
303=upper travel stop
304=upper crimp ring seating surface
305=interior first o-ring sealing surface
306=outer retaining ring groove
307=retaining ring compression taper
308=third o-ring groove
400=crimp ring
500=second o-ring retainer
601=adaptor assembly
600=assembly tool
701=first o-ring

702=second o-ring
703=retaining ring
704=third o-ring

As used herein, the term "pin valve" refers to any type of small spring assisted poppet valve. Typically, pin valves have externally threaded hollow cylindrical tubes. In the center of the exterior end is a metal pin pointing along the axis of the tube. The pins end is approximately flush with the proximal end of the valve body. In use, the pressure on the distal end keeps the poppet valve seated, and blocks gas flow from inside the aerosol can. If flow from within the aerosol can is desired, force is applied to the pin, which compresses the spring that holds the poppet valve shut. As the poppet valve comes unseated, pressurized gas may flow out of the pin valve. (Typical examples of such pin valves would be Shrader valves (also known as American valves), or Presta valves (also known as Sclaverand valve or French valve)

As used herein, the term "aerosol can" refers to typical crimped construction tinplate or aluminum containers, while other construction materials such as polymers may be used. These may be 1-piece, 2-piece, or 3-piece construction. These may also be referred to as "inner receptacles". It is also understood, that the present invention may applied to other pressurized cylinders if needed.

Figure 1:
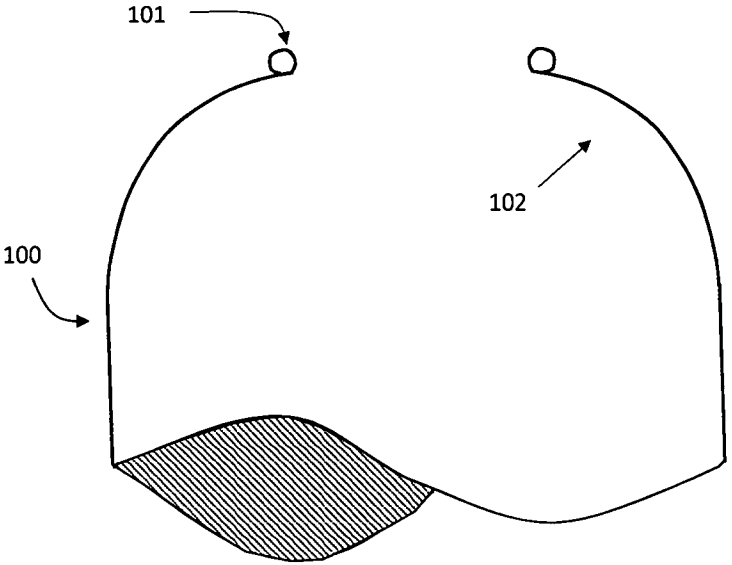
Figure 1 PRIOR ART
FIG. 1 is a cut-away schematic representation of a aerosol can as known in the art.

Turning to FIG. 1, a typical aerosol can 100 is presented. The aerosol can 100 has a curled lip 101 and an inner surface 102. The aerosol can 100 may contain R135a.

Figure 2A:
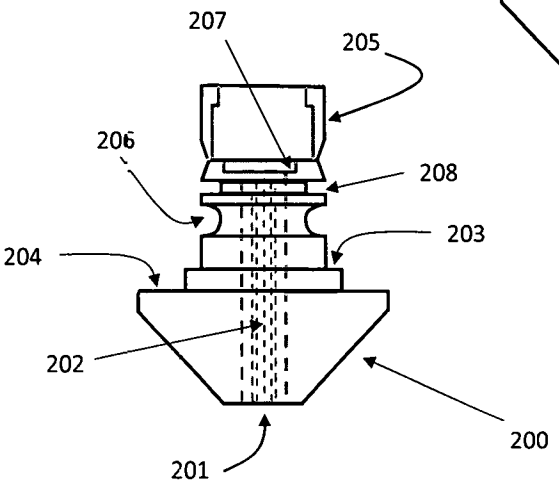
FIG. 2*a* is a schematic representation of the lower fitting.

Turning to FIG. 2*a*, a lower fitting 200 including a central, axial opening 201, including a pin valve 202, a lower travel stop 203, and a lower crimp ring seating surface 204 is presented. The pin valve 202 may be a Schrader valve, or American valve. The pin valve 202 may be a Presta valve, Sclaverand valve, or French valve. The lower fitting 200 may include an exterior first o-ring groove 206, configured to mate with a first o-ring 701. The lower fitting 200 may include a second o-ring seat 207, configured to mate with a second o-ring 702. The lower fitting 200 may include an inner retaining ring groove 208, configured to mate with a retaining ring 703.

The lower fitting 200 may also include a pull-ring 205 which is configured to accept an assembly tool 600, and which is configured to shear upon completion of assembly, and separate from the lower fitting 200*a*, as indicated in FIG. 2*b*.

Figure 3B:
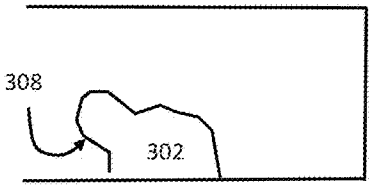
FIG. 3*b* is an enlarged view of the upper fitting illustrating the seating radius and the third o-ring groove.
Figure 3A:
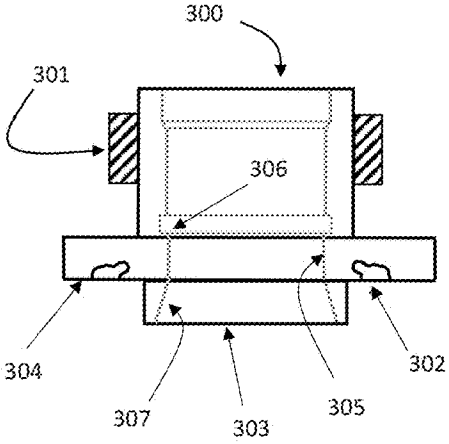
FIG. 3*a* is a schematic representation of the upper fitting.

Turning to FIG. 3*a*, an upper fitting 300 including a male thread 301, a seating radius 302 configured to conform with a curled lip 101 of the aerosol can 100, an upper travel stop 303, configured to contact the lower travel stop 203 during assembly, and an upper crimp ring seating surface 304 is provided. The male thread 301 may be compatible with a female CGA-600 connection. The upper fitting 300 may include an interior first o-ring sealing surface 305 configured to seal against the first o-ring 701 during assembly. The upper fitting 300 may include an outer retaining ring groove 306, configured to mate with the retaining ring 703 during assembly. The upper fitting 300 may include a retaining ring compression taper 307, configured to compress the retaining ring 703 during assembly.

The upper fitting 300 may also include a third o-ring groove 308 configured to mate with a third o-ring 704 and to seal against a curled lip 101 of the aerosol can 100, as indicated in FIG. 3*b*.

Figure 4:
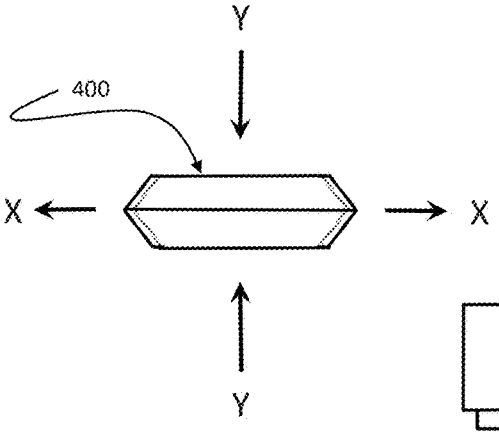
FIG. 4 is a schematic representation of the crimp ring.

Turning to FIG. 4, a crimp ring 400, configured to rest between the lower crimp ring seating surface 204, and the upper crimp ring seating surface 304, and configured to compressed in the axial direction (Y) while simultaneously expanding in the radial direction (X) during installation is presented.

Figure 5:
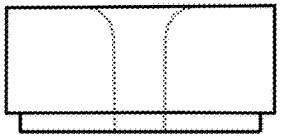
FIG. 5 is a schematic representation of the $2^{nd}$ o-ring retainer.

Turning to FIG. 5, a second o-ring retainer 500, configured to seal against the second o-ring 702 during assembly is presented.

Figure 6:
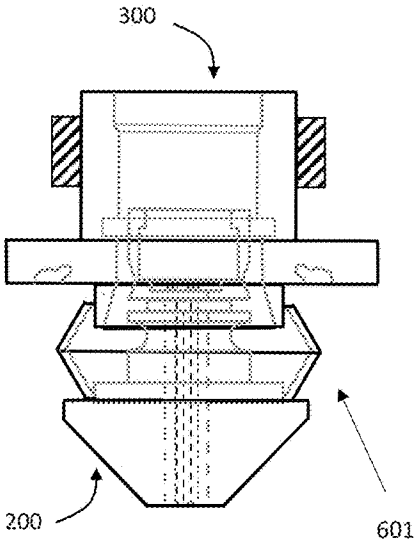
FIG. 6 is a schematic representation of the upper fitting, the lower fitting and the crimp ring assembly, before installation.

Turning to FIG. 6, a method of adapting a threaded connection 301 to an aerosol can 100 is presented. The aerosol can 100 may contain R135a. The method includes providing a lower fitting 200 including a central, axial opening 201, including a pin valve 202, a lower travel stop 203, and a lower crimp ring seating surface 204 (as described in FIG. 2*a*). The pin valve 202 may be a Schrader valve, or American valve. The pin valve 202 may be a Presta valve, Sclaverand valve, or French valve. The method includes providing an upper fitting 300 including a male thread 301, a seating radius 302 configured to conform with a curled lip 101 of the aerosol can 100, an upper travel stop 303, configured to contact the lower travel stop 203 during assembly, and an upper crimp ring seating surface 304 (as described in FIG. 3*a*). The male thread 301 may be compatible with a female CGA-600 connection.

Figure 11:
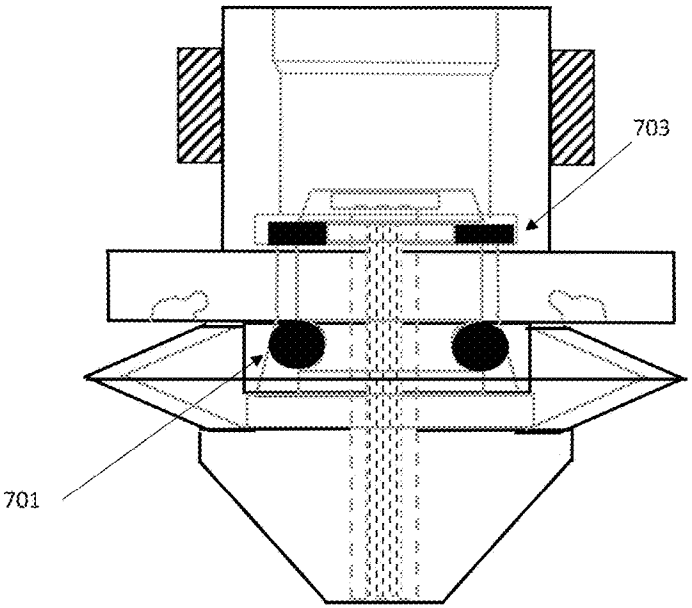
FIG. 11 is a schematic representation of the adaptor assembly after installation, illustrating the second o-ring.

As described in FIGS. 2*a*, 3*a*, and 11, the lower fitting 200 may include an exterior first o-ring groove 206, configured to mate with a first o-ring, and providing a interior first o-ring sealing surface 305 on the upper fitting 300 configured to seal against the first o-ring 701 during assembly, thereby sealing the lower fitting 200 against the upper fitting 300.

The lower fitting 200 may include an inner retaining ring groove 208, configured to mate with a retaining ring 703, and the upper fitting 300 may include an outer retaining ring groove 306, configured to mate with the retaining ring 703 during assembly, thereby locking the lower fitting 200 to the upper fitting 300. The upper fitting 300 may include a retaining ring compression taper 307, configured to compress the retaining ring during assembly. As lower fitting 200 passes through upper fitting 300, the retaining ring 703 contacts retaining ring compression taper 307, thereby causing the retaining ring 703 to slightly compress into inner retaining ring groove 208. As the lower fitting 200 is fully inserted into upper fitting 300, the inner retaining ring grove 208 and outer retaining ring grove 306 become aligned, and retaining ring 703 snaps into place, securing both fittings together.

Figure 12:
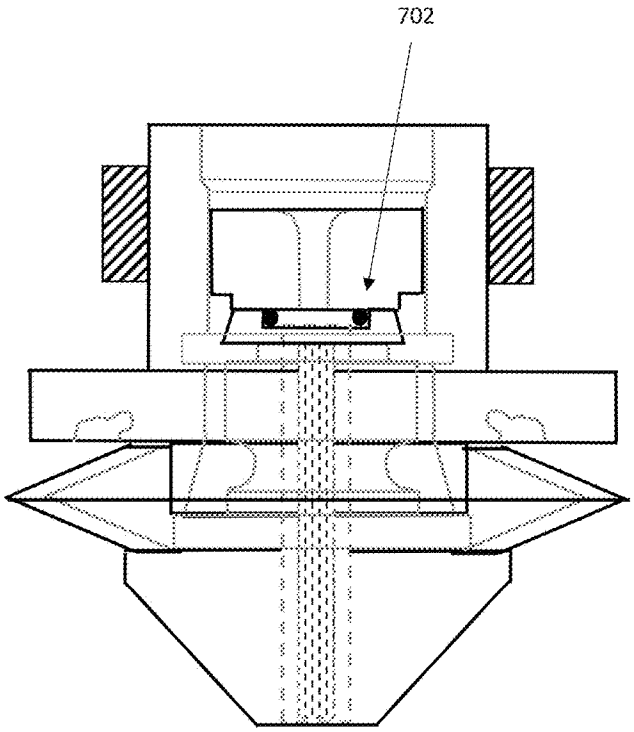
FIG. 12 is a schematic representation of the aerosol can and adaptor assembly after assembly, illustrating the third o-ring.

As described in FIGS. 2*a*, 5, and 12. the lower fitting 200 may include a second o-ring seat 207, configured to mate with a second o-ring 702, and a second o-ring retainer 500, configured to seal against the second o-ring 702 during assembly, thereby sealing the lower fitting 300 against a device mating to the male thread 301.

Figure 8:
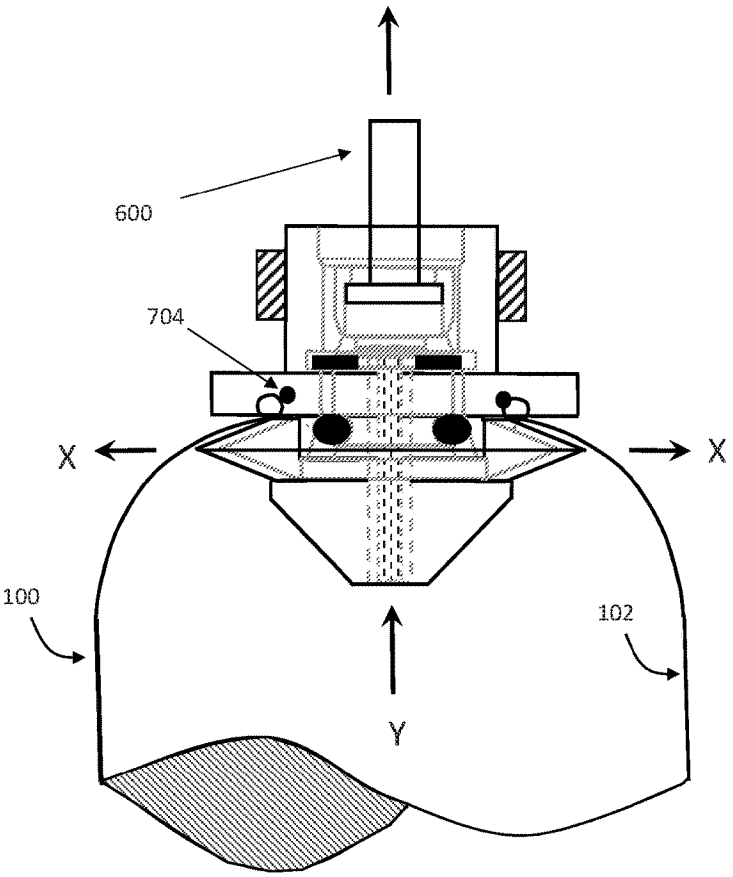
FIG. 8 is a schematic representation of the upper fitting, the lower fitting the crimp ring assembly and the assembly tool, inserted into an aerosol can, during installation, illustrating the deformation of the crimp ring.

As described FIGS. 1, 3*a*, and 8, the upper fitting 300 may include a third o-ring groove 308 configured to mate with a third o-ring 704 and to seal against a curled lip 101 of the aerosol can 100.

As described in FIGS. 4 and 6, the method also includes providing a crimp ring 400, configured to rest between the lower crimp ring seating surface 204 and the upper crimp ring seating surface 304. The method includes inserting the lower fitting 200 into the crimp ring 400 and the upper fitting 300, thereby forming an adaptor assembly 601.

Figure 7:
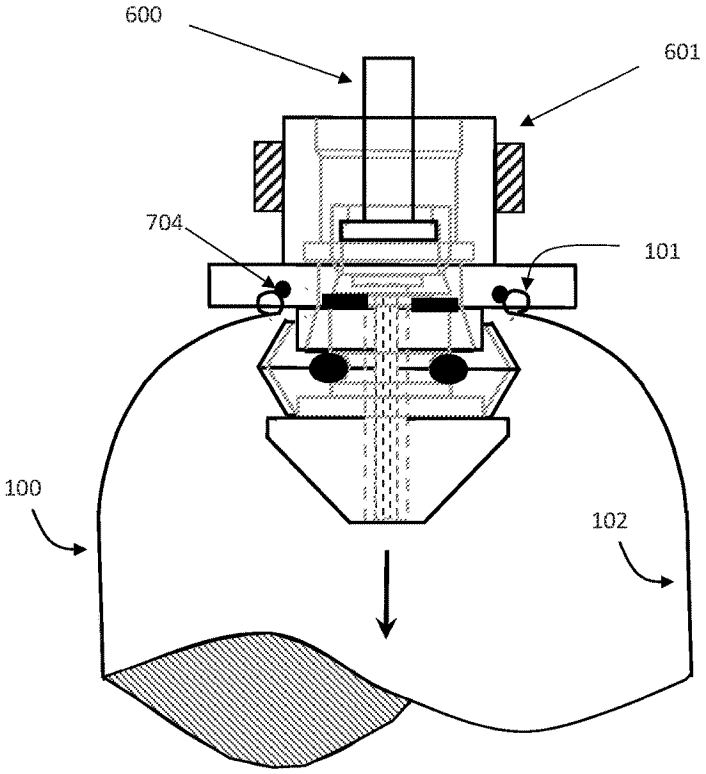
FIG. 7 is a schematic representation of the upper fitting, the lower fitting the crimp ring assembly and the assembly tool, inserted into a aerosol can, before installation.

Turning to FIG. 7, the method includes inserting the adaptor assembly 601, lower fitting 200 end first, into the aerosol can 100, the aerosol can 100 comprising an inner surface 102.

Turning to FIG. 8, the method includes providing a pull-ring 205 which is configured to accept an assembly tool

600. The assembly tool 600 is used to pull the lower fitting 200 through the upper fitting 300, thereby compressing the crimp ring 400 in the axial (Y) direction while simultaneously expanding in the radial (X) direction. The expanded crimp ring 400 thereby makes contact with the inner surface 102 and fixedly installing the adaptor assembly in the aerosol can 100.

Figure 10:
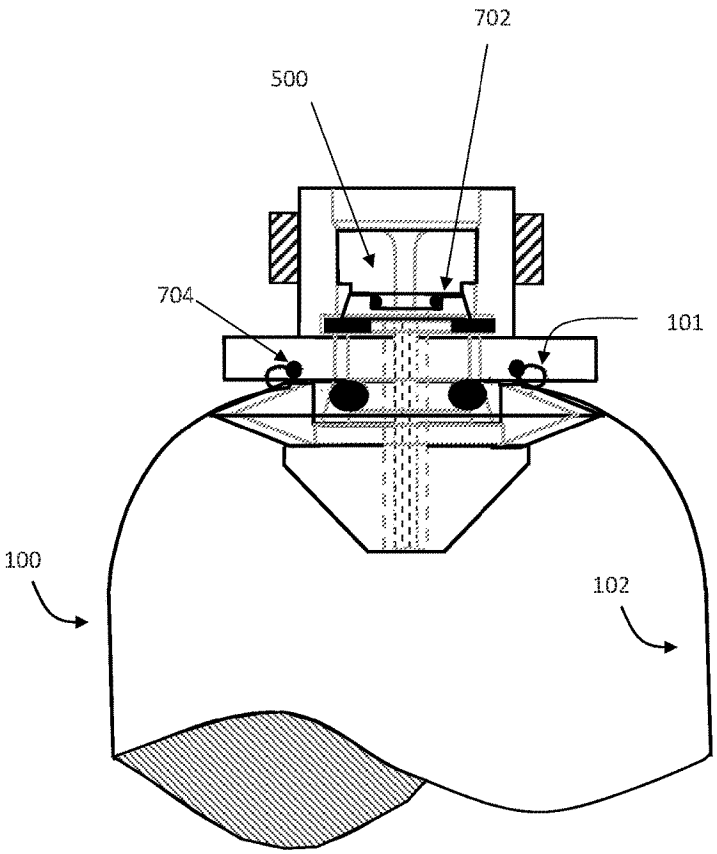
FIG. 10 is a schematic representation of the adaptor assembly after installation in an aerosol can, illustrating the first o-ring and the retaining ring.
Figure 9:
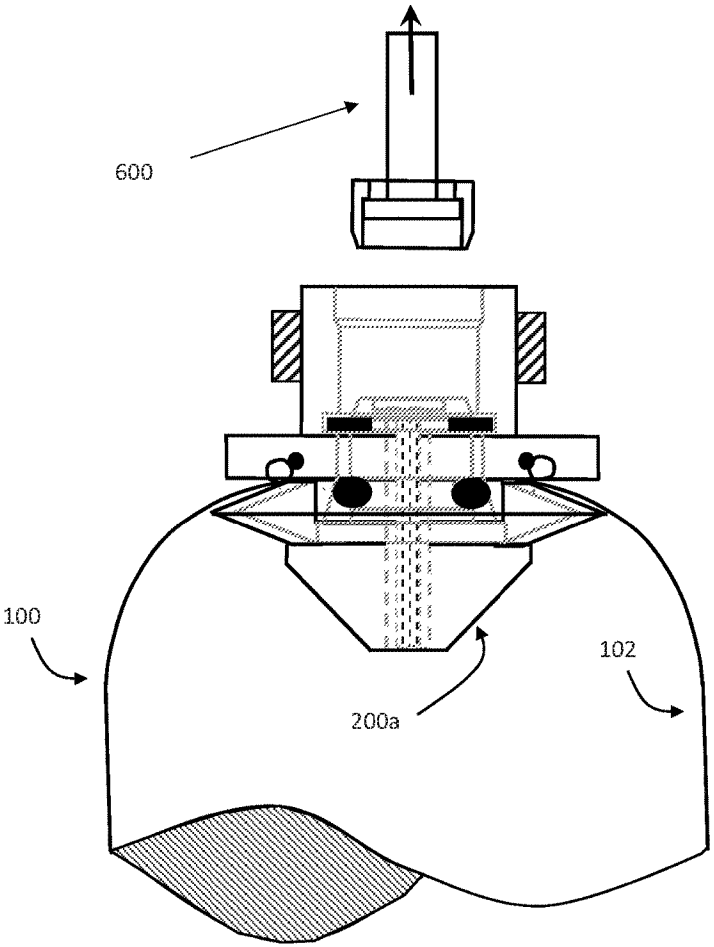
FIG. 9 is a schematic representation of the upper fitting, the lower fitting the crimp ring assembly and the assembly tool, inserted into an aerosol can, during installation, illustrating the separation of the pull-ring and assembly tool.

Turning to FIGS. 9, 10, and 12, upon completion of assembly, the pull-ring 205 is configured to shear away from the lower fitting 200*a*, and the second o-ring 702 and the second o-ring retainer 500 are installed.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

The invention claimed is:

1. An adaptor comprising:

a lower fitting (200) comprising:

a central, axial opening (201) comprising a pin valve (202), a lower travel stop (203), and a lower crimp ring seating surface (204), an upper fitting (300) comprising:

a male thread (301), a seating radius (302) configured to conform with a curled lip (101) of an aerosol can (100), an upper travel stop (303), configured to contact the lower travel stop (203) during assembly, an upper crimp ring seating surface (304), and a crimp ring (400), configured to rest between the lower crimp ring seating surface (204), and the upper crimp ring seating surface (304), and configured to be compressed in an axial direction (Y) while simultaneously expanding in a radial direction (X) during installation.

2. The adaptor of claim 1, further comprising a pull-ring (205) which is configured to accept an assembly tool (600), and which is configured to shear upon completion of assembly, and separate from the lower fitting (200*a*).

3. The adaptor of claim 1, wherein the male thread (301) is compatible with a female CGA-600 connection.

4. The adaptor of claim 1, further comprising:

an exterior first o-ring groove (206), configured to mate with a first o-ring (701), and a interior first o-ring sealing surface (305) configured to seal against the first o-ring (701) during assembly.

5. The adaptor of claim 1, further comprising:

a second o-ring seat (207), configured to mate with a second o-ring (702), and a second o-ring retainer (500), configured to seal against the second o-ring (702) during assembly.

6. The adaptor of claim 1, further comprising:

an inner retaining ring groove (208), configured to mate with a retaining ring (703), an outer retaining ring groove (306), configured to mate with the retaining ring (703) during assembly, a retaining ring compression taper (307), configured to compress the retaining ring (703) during assembly.

7. The adaptor of claim 1, further comprising a third o-ring groove (308) configured to mate with a third o-ring (704) and to seal against the curled lip (101) of the aerosol can (100).

8. The adaptor of claim 1, wherein the aerosol can (100) contains R135a.

9. The adapter of claim 1, wherein the pin valve (202) is a Schrader valve.

* * * * *